US007729622B2

(12) United States Patent
Yamanaka

(10) Patent No.: US 7,729,622 B2
(45) Date of Patent: Jun. 1, 2010

(54) IMAGE FORMING APPARATUS FOR DISPLAYING A MESSAGE WHEN A REMAINING AMOUNT OF CONSUMABLE BECOMES LESS

(75) Inventor: Shuichi Yamanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/332,173

(22) Filed: Jan. 17, 2006

(65) Prior Publication Data

US 2006/0171724 A1 Aug. 3, 2006

(30) Foreign Application Priority Data

Feb. 2, 2005 (JP) ..... 2005-026322

(51) Int. Cl.
*G03G 15/00* (2006.01)

(52) U.S. Cl. ..... 399/8

(58) Field of Classification Search ..... 399/8, 399/24, 27

See application file for complete search history.

(56) References Cited

U.S. PATENT DOCUMENTS 6,233,409 B1 * 5/2001 Haines et al. ..... 399/10
2003/0040984 A1 * 2/2003 Inami et al. ..... 705/27

FOREIGN PATENT DOCUMENTS

JP 04047964 A * 2/1992
JP 2003-063104 3/2003

* cited by examiner

*Primary Examiner*—David M Gray
*Assistant Examiner*—Erika Villaluna
(74) *Attorney, Agent, or Firm*—Rabin & Berdo, P.C.

(57) ABSTRACT

To eliminate a possibility to induce a user's confusion on an image forming apparatus displaying a message prompting the user to supply consumables if a remaining amount of the consumables becomes less than a prescribed amount. Communication section receives an order defining information from an external device, storing section stores the order defining information thus received, and control section halts the message prompting the user to supply the consumables in accordance with the order defining information stored in storing section.

8 Claims, 9 Drawing Sheets

Code : Color

Bk : Black
Y : Yellow
M : Magenta
C : Cyan (A)REMAINING TONER IS SMALL (B)REMAINING TONER IS SMALL (C) REMAINING TONER IS LARGE (D)REMAINING TONER IS LARGE Code : Color

---

Bk : Black
Y : Yellow
M : Magenta
C : Cyan

IMAGE FORMING APPARATUS FOR DISPLAYING A MESSAGE WHEN A REMAINING AMOUNT OF CONSUMABLE BECOMES LESS

BACKGROUND OF THE INVENTION

1. Field of the Invention

The present invention relates to an image forming apparatus for displaying a message to supply consumables when remaining amount becomes less.

2. Description of Related Art

A user using the image forming apparatus such as a printer, a copying machine, a facsimile machine and the like has to buy and exchange consumables such as a cartridge for storing a toner, an image drum cartridge integral with, a photosensitive drum, a charging unit, a developing unit, and the like, as required. Upon the use of the image forming apparatus by the user, the above mentioned consumables will be consumed according to his use, resulting in inviting an inoperative condition of the apparatus. To avoid such condition, the following measures have been taken. In these measures, a case of the toner is exemplified that a remaining amount detecting means built in the apparatus detects that a remaining amount of the toner becomes less than a prescribed amount and displays a message indicative of this information on an operation panel of the image forming apparatus or on a display connected to a personal computer (hereinafter referred to as "PC"), thereby calling the user's attention so as to have the user prepare a new toner. Further, alternative measures are proposed that an ordering means which the user can operate by himself is built in the image forming apparatus, or that an automatic ordering means sends an order request signal to the consumption administration apparatus disposed independently from the image forming apparatus, or the like (see Patent Laying-Open No. 2003-063104).

In these image forming apparatuses, for example, alike a color printer using toners of four colors, when "black toner LOW" as to a black toner, for instance, is displayed, the message will be kept displaying until the black toner cartridge will be exchanged. Therefore, after the user has ordered the black toner, a message of "cyan toner LOW", for example, might be displayed. Under such condition, there has been a case that the user may overlook such a new message of "cyan toner LOW" subsequent to the message of "black toner LOW" because of the user's confusion between the black toner and the cyan toner since they belong to the same kind of consumables.

The problems the present invention attempts to resolve are how to eliminate the user's confusion that may be induced by the message prompting to order the required consumables under such circumstances that the message is kept displaying until the required consumables are actually exchanged even after the consumables required to be exchanged has already been ordered.

SUMMARY OF THE INVENTION

The present invention is featured mainly in comprising a communication section for receiving, upon completion of an order of consumables required to be exchanged, an order defining information from an external device and a storing section for storing thus received order defining information, in which a control section serves to halt the message to supply the above mentioned consumables, i.e., the message of "black toner LOW" as described above, in accordance with the order defining information stored in the above storing section.

The present invention produces an advantageous effect that, after receiving the order defining information indicative of completion of the order of the consumables from the external device, the message for prompting the user to order the consumables having already been ordered will not be displayed on a display section any more, thereby being capable of eliminating the possible inducement of the user's confusion.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

The image forming apparatus according to the present invention is so structured as not only having the display section halt the message indicative of prompting the user to order the consumables but also having the display section display "new error occurrence" in order to arouse the user's attention upon the need for a new message independent from the presently-displayed message indicative of prompting the user to order the consumables, after receiving the order defining information indicative of completion of the order of the consumables from the external device.

Figure 1:
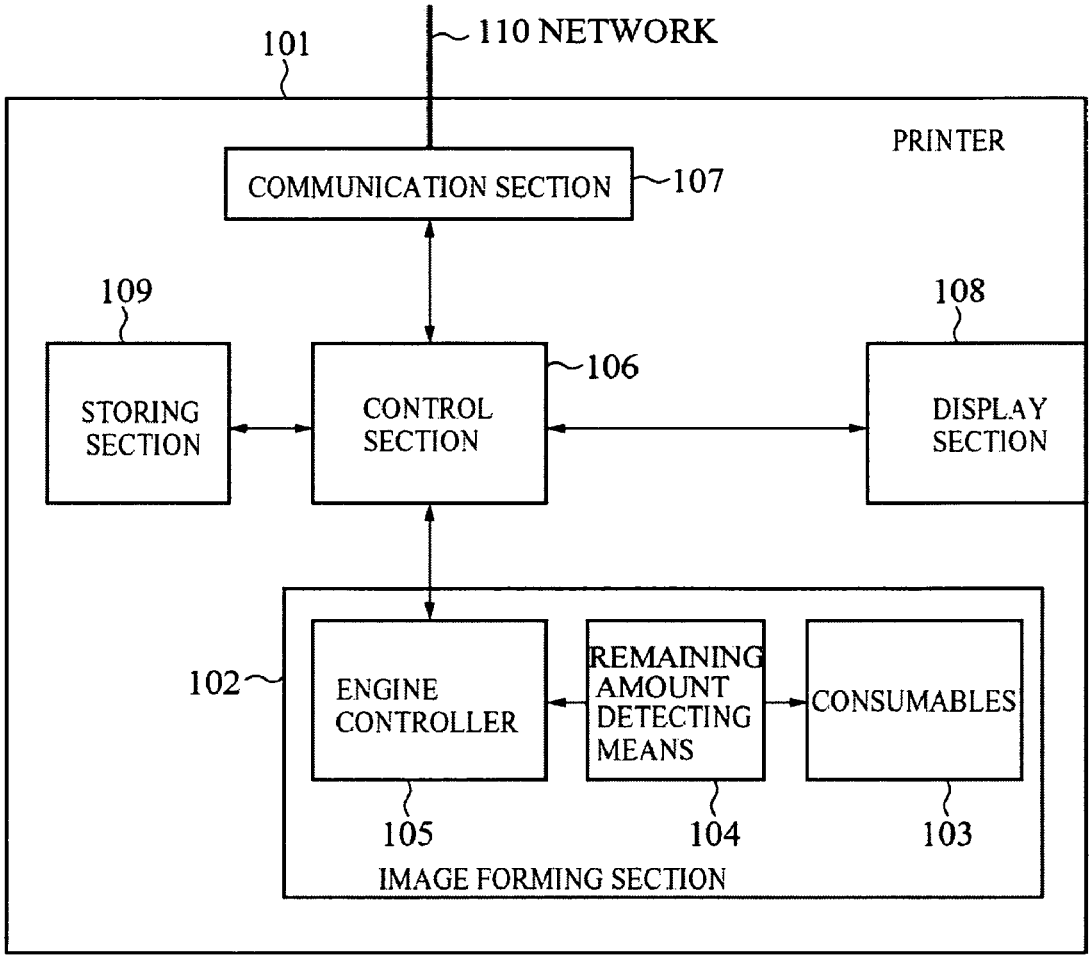
FIG. 1 is a block diagram illustrating a printer configuration according to a first embodiment.

FIG. 1 is a block diagram illustrating a printer configuration according to a first embodiment.

As shown in FIG. 1, printer 101 according to the first embodiment has image forming section 102, control section 106, communication section 107, display section 108 and storing section 109.

Image forming section 102 serves to form an image onto a predetermined print medium according to print data received from control section 106. In addition to a function (ordinary function) for forming the image, the present embodiment includes a further function to measure a remaining amount of the consumables. Here, an explanation of the ordinary function is omitted and the explanation of the mere function to measure the remaining amount of the consumables follows. To execute the function to measure the remaining amount of the consumables, image forming section 102 includes therein consumables 103, remaining amount detecting means 104 and engine controller 105.

Consumables 103 means consumable materials in printing that are required to be exchanged or added upon excess of a predetermined number of print media, such as cartridges for storing toners color by color, an image drum cartridge integral with a photo conductor, a charging device, a development apparatus and the like. Remaining amount detecting means 104 is a means for detecting the remaining amount of the consumables. Here, a toner is exemplified as the consumables in order to explain the toner remaining amount detecting means for detecting the remaining amount of the toner.

Figure 2:
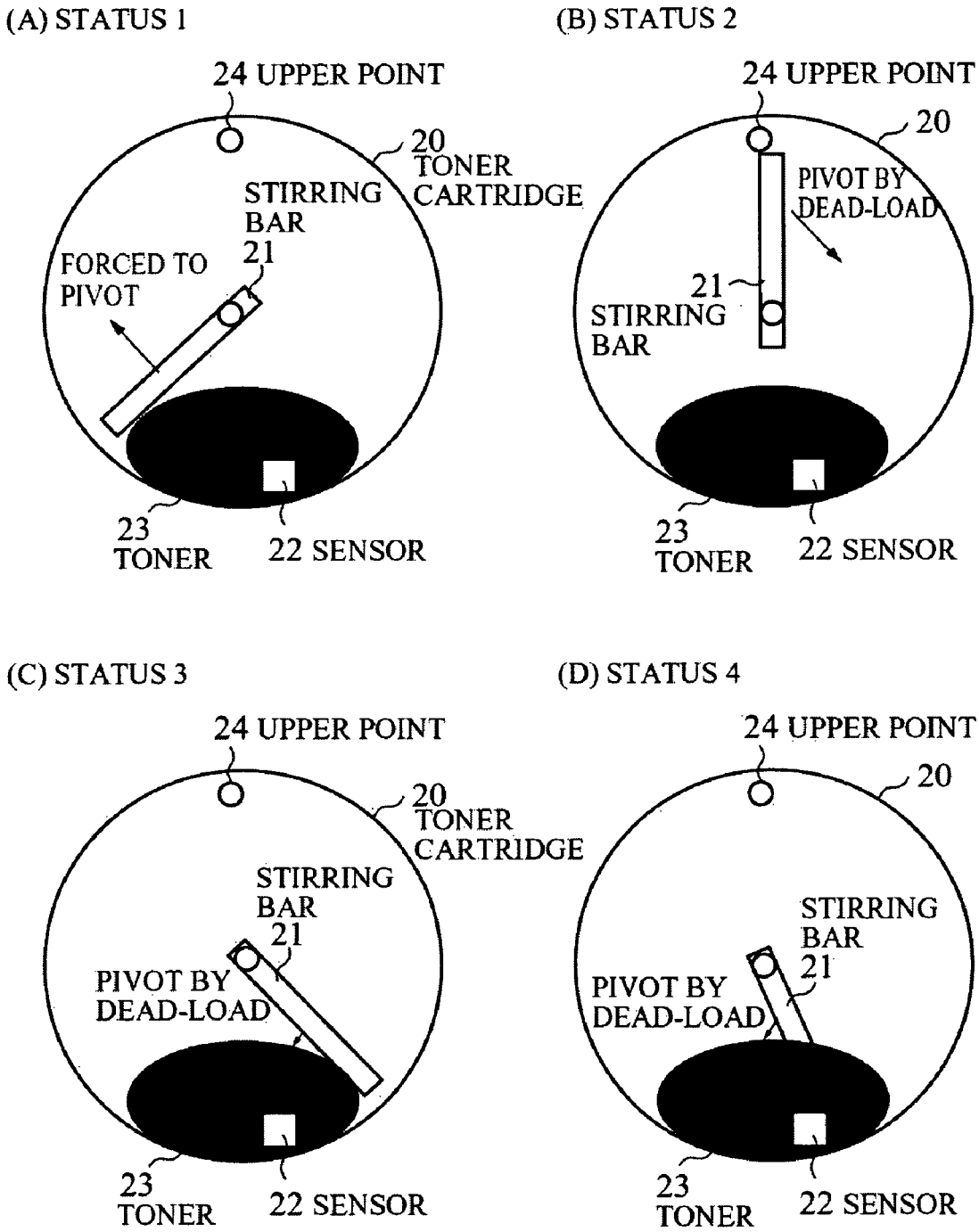
FIG. 2 illustrates a function of a remaining amount detecting means of toner at pivoting rate of a stirring bar.

FIG. 2 illustrates a function of the toner remaining amount detecting means at a pivoting rate of a stirring bar.

FIG. 2(*a*) illustrates status 1, (*b*) illustrates status 2, (*c*) illustrates status 3, and (*d*) illustrates status 4, respectively.

As shown in the illustrations, toner cartridge 20 includes therein stirring bar 21 which is forced to pivotally move to upper point 24 (status 1) by a motor or the like not shown here, and sequentially stirring bar 21 pivots by its dead-load (status 2). Stirring bar 21, until contacting toner 23, pivots by its dead-load without any resisting force in the air (status 3), whereas after contacting toner 23, stirring bar 21 continues to pivot by its dead-load with receiving resistance by the toner and further pivots until stirring bar 21 passes sensor 22 (status 4). Then, the motor or the like, which are not illustrated, forces to pivot stirring bar 21 until it reaches to upper point 24, resulting in repeating the pivot in a similar manner.

Figure 3:
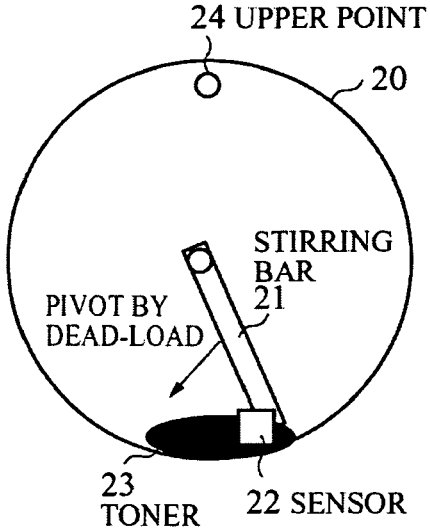
FIG. 3 illustrates sensor signal waves depending on a difference of the remaining amount of the toner.
Figure 3:
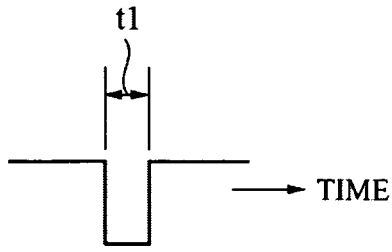
Figure 3:
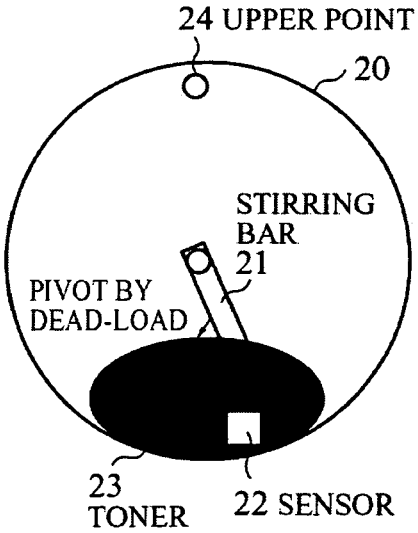
Figure 3:
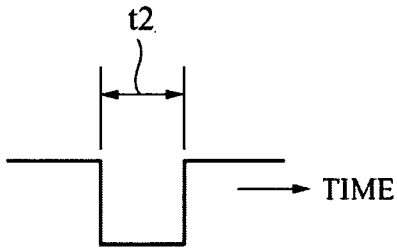

FIG. 3 illustrates kinds of sensor signal waves according to difference in the remaining toner amount.

FIG. 3(*a*) illustrates a status where the remaining amount of the toner is small, (*b*) illustrates a sensor signal wave where the remaining amount of the toner is small, (*c*) illustrates a status where the remaining amount of the toner is large, and (*d*) illustrates a sensor signal wave where the remaining amount of the toner is large, respectively. What is represented, respectively, by t1, t2 in FIGS. 3(*b*) and (*d*) is blocked time period in which signal path of sensor 22 is blocked by stirring bar 21. Here, the signal path of sensor 22 is formed in such a manner, for example, that two magnets having opposite polarities are placed across a pivoting route of stirring bar 21 in a vertical direction of the sheet surface of FIG. 3 to form the signal path of a magnetic path routing between those magnetic polarities.

In FIG. 3(*a*), since the remaining amount of toner 23 is small, resistant power by the toner that blocks stirring bar 21 is also small, resulting in the short blocked time period t1. In FIG. 3(*b*), since the remaining amount of toner 23 is large, resistant power by the toner that blocks stirring bar 21 is also large, resulting in the long blocked time period t2. As stated above, the measurement of the blocked time period t in which the signal route of sensor 22 is blocked by stirring bar 21 enables the measurement of the remaining amount of the toner.

Now turning to FIG. 1, engine controller 105 controls a print engine in accordance with a control by controlling section 106. In addition to an ordinary function to form an image by controlling the print engine, the engine controller also functions to receive the measurement result of the remaining quantities of consumables from remaining amount detecting means 104 to send it to controlling section 106 as the remaining amount information. As stated above, in the case where the remaining amount of toner 23 (FIG. 3) is measured as an example of the remaining quantities of the consumables, the blocked time period t in which the signal path of sensor 22 (FIG. 3) as a signal output of sensor 22 (FIG. 3) is output to control section 106 as the remaining amount information.

Control section 106 having CPU (micro-processor), ROM (read only memory) and RAM (random access memory), not shown, serves to control the apparatus in its entirety. In other words, the control section 106 receives and analyzes the incoming data from a host device (e.g. personal computer) through communication section 107, creates and sends print data to image forming section 102, and further controls printing operation of image forming section 102 through engine controller 105. Specifically, in the present embodiment, in addition to the ordinary function for controlling the entire apparatus, the present embodiment further comprises a function in which, when the remaining quantities of the consumables become lower than the preset quantities, the control section 106 allows display section 108 to display a message (e.g., "black toner LOW" as mentioned above) to prompt the user to supply the consumables on display section 108 as well as allows storing section 109 to store "black toner LOW" as necessary information. The control section 106 further has a function to halt the message to prompt the user to supply the above consumables in response to the order defining information stored in storing section 109. This function is activated when CPU executes a predetermined program stored preliminary in ROM.

In this embodiment, display section 108 serves to notify the user by means of a message to prompt the user to supply the consumables when the remaining amount of the consumables becomes less than the prescribed amount in addition to the ordinary function to inform the user upon indicating a controlling status of the entire apparatus based on a control of control section 106. Display section 108 may be ordinary liquid crystal displaying apparatuses and the like.

Storing section 109 is a memory that stores (registers) a content of the message to prompt the user to supply the consumables (e.g., "black toner LOW" stated above) under control of control section 106 as well as stores the order defining information that control section 106 received from the external device through communication section 107. Normally, nonvolatile memories such as FlashROM or EEPROM or the like are used as the storing section. Here, the order defining information is such a notification received from the external device, as stating that an order of the consumables of the remaining amount less than the prescribed amount has already been completed. This order defining information has to be saved even after the apparatus is switched-off. Therefore, storing section 109 is composed of the nonvolatile memory.

Communication section 107 is an interface section for establishing a communication with the external device through network 110.

Explained hereinafter is general idea as to the network configuration capable of connecting printer 101 according to the present embodiment to the external device through network 110.

Figure 4:
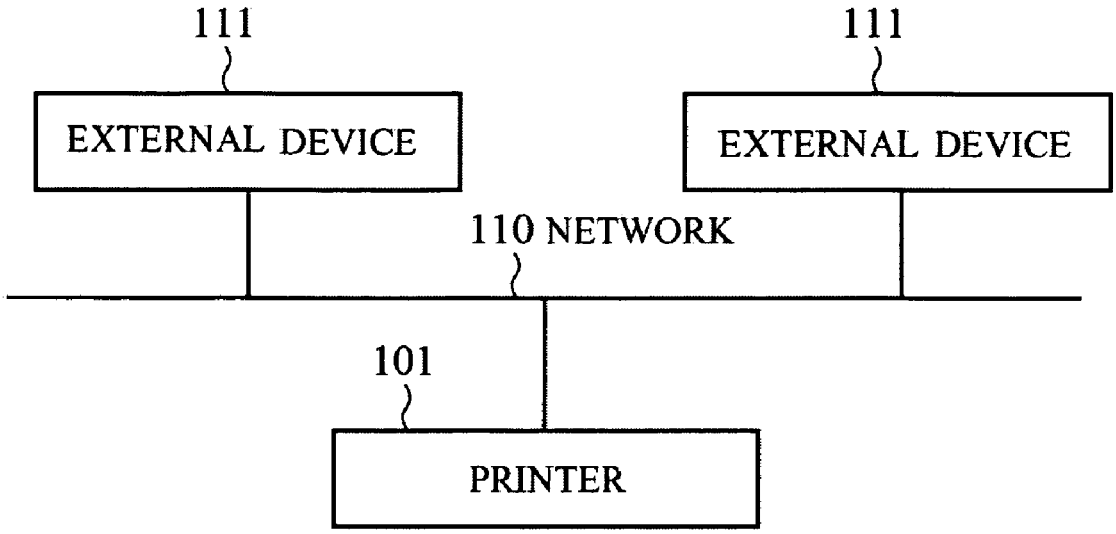
FIG. 4 illustrates a network configuration according to the printer of the first embodiment.

FIG. 4 is a schematic view illustrating network configuration of the printer according to the present embodiment.

As shown in FIG. 4, external device 111 is mutually connected through network 110 to printer 101 and thus printing instruction data are transferred from any external device 111 to printer 101 to perform printing operation.

Explained hereinafter is the sending/receiving of signals relating to the present invention that is executed between an interior of printer 101 and external device 111 through network 110.

The remaining amount information of the consumables measured by remaining amount detecting means 104 is sent to engine controller 105. The remaining amount information of the consumables is then sent from engine controller 105 to control section 106. Control section 106, when detecting that the remaining amount of the consumables becomes less than the prescribed amount, requests display section 108 to display the message for prompting the user to supply the consumables. Display section 108 then displays the message to the extent that the user is required to supply the consumables. In accordance with the message for prompting the user to supply the consumables, the user orders the desired consumables of which order defining information is sent from external device 111 through network 110 to communication section 107.

Control section 106 receives the order defining information from communication section 107 to allow storing section 109 to store it. Simultaneously, control section 106 allows display section 108 to halt the message to prompt the user to supply consumables.

Operation of the printer according to the present embodiment is explained next referring to a flow chart.

Figure 5:
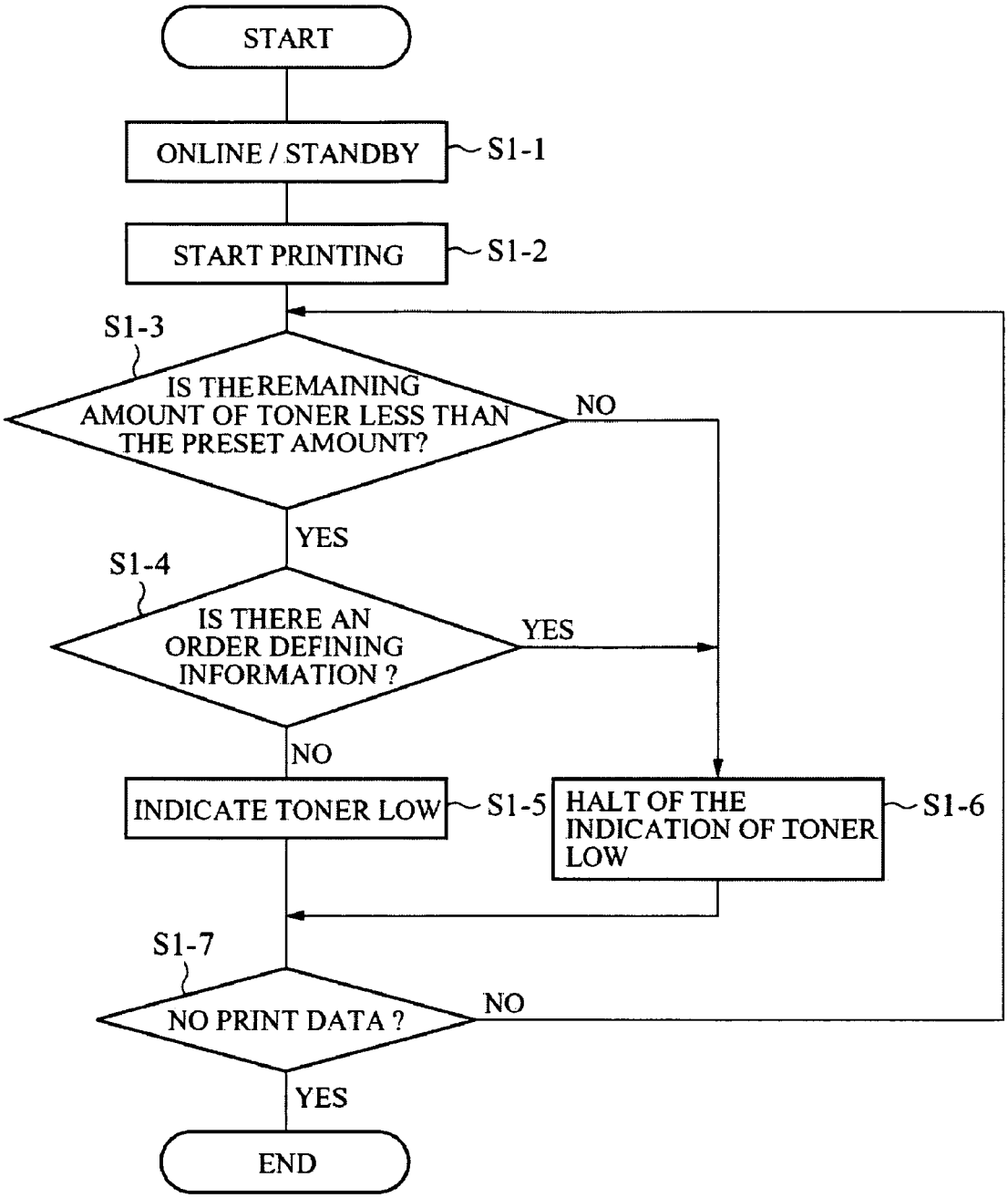
FIG. 5 is a flow chart illustrating a sequence of the printing operation of the printer according to the first embodiment.

FIG. 5 is a flow chart showing printing operation of the printer according to the present embodiment.

A flow of the order message of the consumables (a toner is exemplified here) of which remaining amount becomes small is explained from step S1-1 to step S1-7 in FIG. 5 in this order. An explanation of an ordinal operation of the printer is omitted here.

Step S1-1

Printer 101 according to the first embodiment (FIG. 1) is in a state of STANDBY with a power switch on.

Step S1-2

Printer 101 according to the first embodiment (FIG. 1) starts printing operation upon receiving a request of printing from external device 111 (FIG. 4).

Step S1-3

Upon starting the printing operation, remaining amount detecting means 104 (FIG. 1) measures a blocked time period t (FIG. 3) during which a signal route of the sensor (FIG. 3) is blocked by stirring bar 21 (FIG. 3) to send it through engine controller 105 (FIG. 1) to control section 106 (FIG. 1). Control section 106 (FIG. 1) upon receiving the blocked time period t (FIG. 3) monitors the remaining amount of the toner, and if the remaining amount of the toner becomes less than the prescribed amount, the step goes to step S1-4 whereas, if the remaining amount of the toner remains more than the prescribed amount, the step goes to step S1-7.

Step S1-4

Control section 106 (FIG. 1) searches storing section 109 (FIG. 1) to detect whether or not the order defining information of the required toner is stored therein, and if such information is not stored, the step goes to step S1-5 whereas if such information is stored, the step goes to step S1-6.

Step S1-5

Control section 106 (FIG. 1) has display section 108 (FIG. 1) display the message to prompt the user to supply the required consumables, e.g., "black toner LOW", since there is no certain evidence indicative of defined order albeit ordering the toner is required as the remaining amount becomes less than the prescribed amount.

Step S1-6

Control section 106 (FIG. 1) has display section 108 (FIG. 1) halt, if any, the message to supply the required consumables, e.g. "black toner LOW", since the remaining amount of the toner is more than the prescribed amount and thus there is no need to order the toner, or the order of the toner has already been defined. If there is no message, such status is maintained.

Step S1-7

Control section 106 (FIG. 1) determines a presence/absence of the print data, and if there are the print data, the step goes back to the step S1-3 to repeat the steps from S1-3 to S1-7, finalizing the flow upon completion of the printing operation of the print data.

As stated above, according to the present embodiment, the possibility to induce the user's confusion can be eliminated since the message prompting the user to order the consumables on the display section is halted after the order defining information indicative of the completion of the order of the consumables is received from the external device.

According to the present embodiment, the control section is explained as one which serves to halt the message prompting the user to supply the toner, e.g., (TONER) if the toner as the consumables has already been ordered. In addition thereto, however, an improvement may include a modification to indicate toner ordering information.

Figure 8:
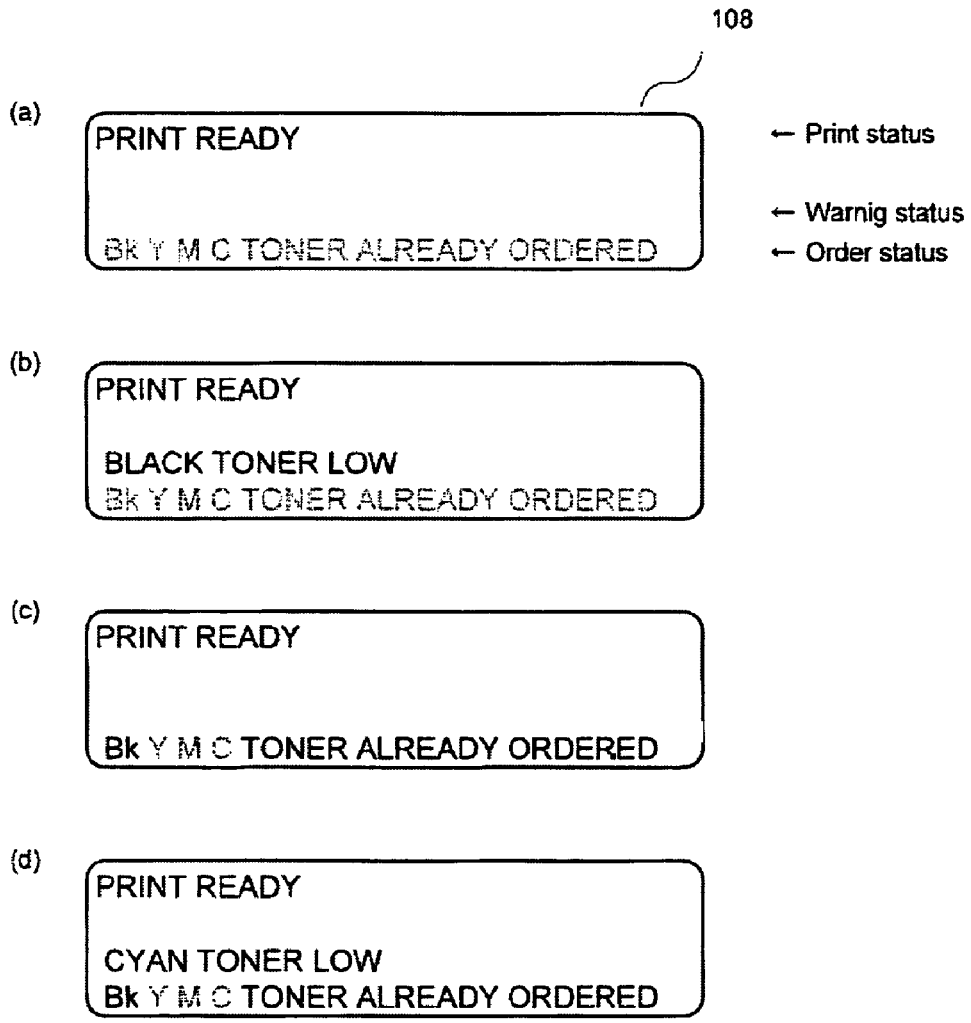

FIG. 8 illustrates examples of contents of messages used in the modification, in which LCD (Liquid Crystal Display) is used as display section 108. In FIG. 8, characters in dark color (BLACK) represent that the message is currently on, whereas characters in light color (GLAY) represent that the message is currently off.

In FIG. 8, (*a*) represents a condition that the toner amount is larger than the prescribed amount, (*b*) represents a condition that the amount of BLACK toner is less than the prescribed amount and there is no order defining information of the toner, (*c*) represents a condition that the amount of BLACK toner is less than the prescribed amount and there is an order defining information of the BLACK toner, and (*d*) represents a condition that the amount of CYAN toner becomes less than the prescribed amount subsequent to the condition (*c*), respectively.

Figure 9:
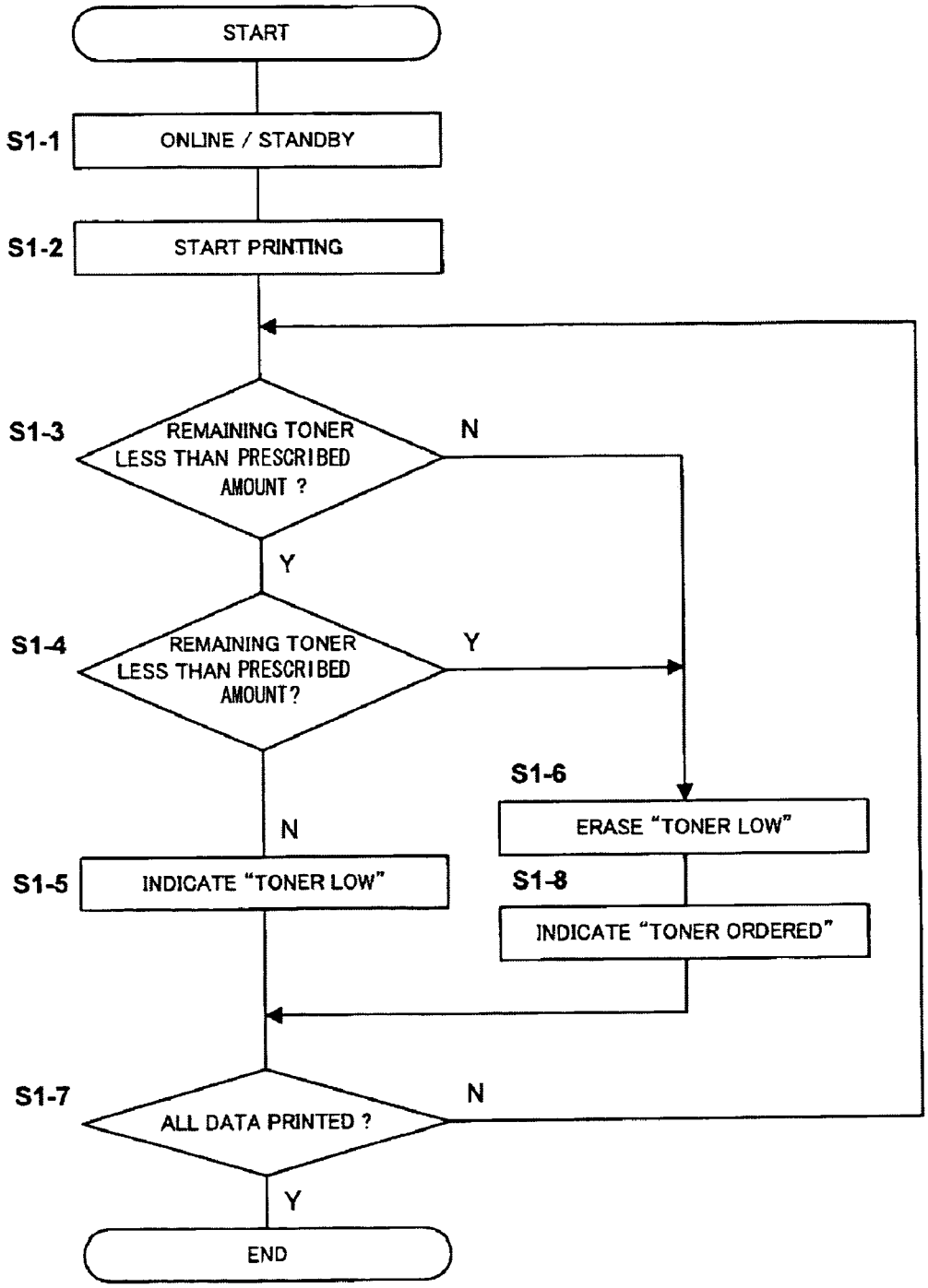

FIG. 9 is a flow chart illustrating printing operation of the printer according to the modification. FIG. 9 differs from FIG. 5 in that the operations goes to step S1-7 (to determine the presence/absence of the print data) through a new step S1-8 after step S1-6 (halt the message of toner LOW).

Step S1-8 displays a message to the extent that the toner corresponding to the color to which the message of "toner LOW" is off in step S1-6 immediately before step S1-8 has already been ordered.

As stated above, the message of the information indicative that the toner has already been ordered enables the user of the apparatus to confirm directly such information, thereby being capable of preventing the user from ordering in error.

According to the present embodiment, when a new message is needed independently from the message indicative of prompting the user to order the consumables as displayed right now, a new message indicative of occurrence of a new error, e.g., "new error occurrence", is displayed in order to draw an attention from the user.

Figure 6:
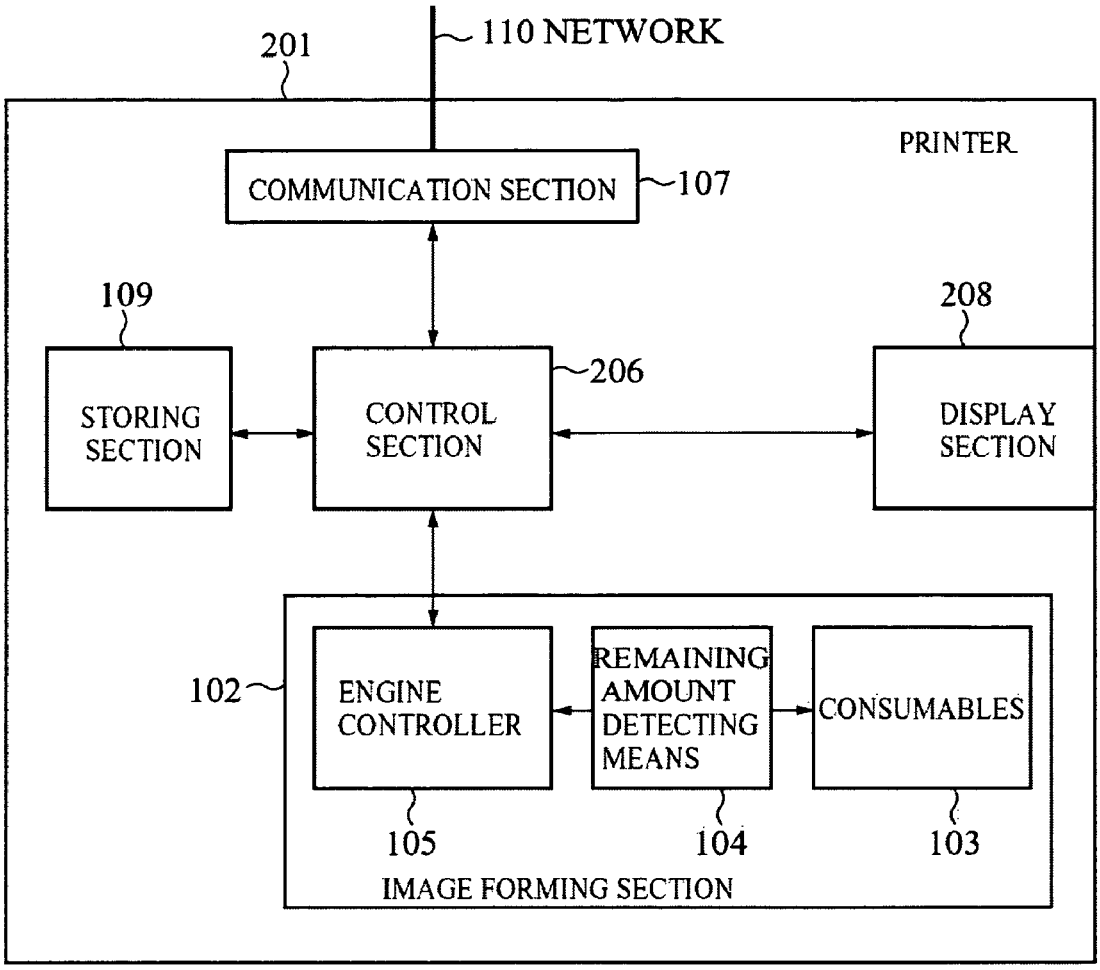
FIG. 6 is a block diagram illustrating the printer configuration according to the second embodiment.

FIG. 6 is a block diagram illustrating the printer configuration according to the second embodiment.

As shown in FIG. 6, printer 201 according to the second embodiment comprises image forming section 102, control section 206, communication section 107, display section 208 and storing section 109. Components not shown in the first embodiment are explained hereinafter. Components as similar to those in the first embodiment will be assigned with similar reference numerals but omitted for their explanations.

Control section 206 comprising CPU, ROM and RAM which are not shown serves to control the entire apparatus. In other words, control section 206 serves to receive and analyze the incoming data through communication section 107, create and output print data to image forming section 102, and further control the printing operation of image forming section 102 through engine controller 105. In particular, according to the present embodiment, in addition to the ordinary function to control the entire apparatus, control section 206 has display section 208 display the message of prompting the user to supply the consumables when the remaining amount of the consumables becomes less than the prescribed amount, and has storing section 109 store a content of the message of prompting the user to supply the consumables as a necessary information as well. Control section 206 has a function to halt the message for prompting the user to supply the consumables in accordance with the order defining information stored in storing section 109. Furthermore, control section 206 further has a function to have display section 208 display a new message indicating a new error occurrence in order to arouse a caution to the user, e.g., "new error occurrence", when a new message becomes necessary independently from the message prompting the user to order the consumables currently indicated. This function is activated when the CPU executes the predetermined program preliminary stored in the ROM.

In addition to the ordinary function in which a controlling condition of the entire apparatus is displayed based on a control according to control section 206 to notify it to the user, display section 208 according to the present embodiment displays a message to prompt the user to supply the consumables when the remaining amount of the consumables becomes less than the prescribed amount to notify the user. Used as display section 208 is the ordinary liquid crystal apparatus and the like. Further, display section 208 serves to indicate a message of new error, e.g., "new error occurrence", to arouse a caution to the user when a new message becomes necessary independently from the message to prompt the user to supply the consumables as currently indicated.

The other components are similar to those of the first embodiment, and therefore, the explanations thereof are omitted here, and the operation of the printer according to the present embodiment is explained here referring to a flow chart.

Figure 7:
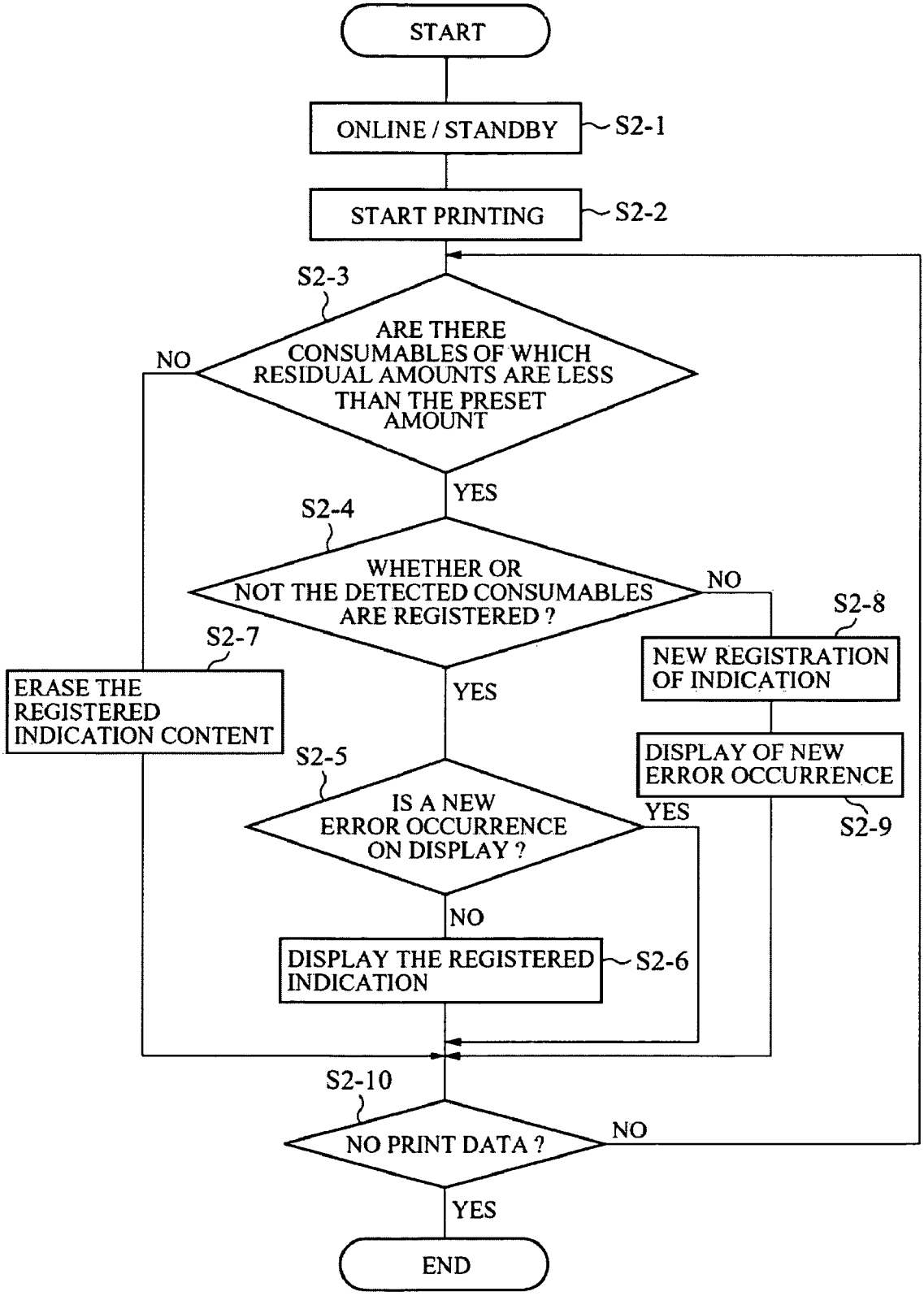
FIG. 7 is a flow chart illustrating a sequence of the printing operation of the printer according to the second embodiment.

FIG. 7 is a flow chart illustrating a printing operation of a printer according to the second embodiment.

Explanation is provided as to a flow of the message for ordering the consumables (a toner is exemplified here limitedly) of the small remaining amount, step by step from the steps S2-1 to S2-10 in this order. An explanation of the ordinary printing operation of the printer is omitted here.

Step S2-1

Printer 201 (FIG. 6) according to the second embodiment is in a state of STANDBY with the power switch on.

Step S2-2

Printer 201 (FIG. 6) according to the second embodiment starts printing operation upon receiving a printing instruction from external device 111 (FIG. 4).

Step S2-3

Upon starting the printing operation, remaining amount detecting means 104 (FIG. 6) measures a blocked time period t (FIG. 3) during which a signal route of sensor 22 (FIG. 3) is blocked by stirring bar 21 (FIG. 3) to output the measured blocked time period t to control section 206 (FIG. 6) though engine controller 105 (FIG. 6). Control section 206 (FIG. 6) receives the blocked time period t (FIG. 3) to monitor the remaining amount of the toner, and if the remaining amount of the toner becomes less than the prescribed amount, the step goes to step S2-4 whereas if the remaining amount of the toner remains more than the prescribed amount, the step goes to step S2-7.

Step S2-4

In control section 206 (FIG. 6), if the content of the message for prompting the user to supply the consumables (for example, "black toner LOW") has been registered in storing section 109 (FIG. 6) as a necessary information, the step goes to step S2-5 whereas if such message is not registered, the step goes to step S2-8.

Step S2-5

Control section 206 (FIG. 6) detects whether or not a message of new error occurrence, e.g., "new error occurrence", and if such message is currently on, the step goes to S2-10 whereas if such message is not on, the step goes to step S2-6.

Step S2-6

Control section 206 (FIG. 6) displays the message prompting the user to supply the consumables (for example, "black toner LOW") in accordance with the content registered in storing section 109 (FIG. 6) to go to step S2-10.

Step S2-7

Control section 206 (FIG. 6) clears the content registered in storing section 109 (FIG. 6) and goes to step S2-10.

Step S2-8

Control section 206 (FIG. 6) registers the content of the message of new error occurrence (for example, "cyan toner LOW") in storing section 109 (FIG. 6) and goes to step S2-9.

Step S2-9

Control section 206 (FIG. 6) has display section 208 (FIG. 6) display the message of new error occurrence, e.g. "new error occurrence", and goes to step S2-10.

Control section 206 (FIG. 6) determines the presence/absence of the print data, and if there are the print data, the step goes back to step S2-3 to repeat the steps from S2-3 to S2-10, and the flow is terminated upon completion of the printing operation of the print data.

As stated above, the present embodiment can produce effect that such a possibility is further decreased as inducing user's confusion by arousing an attention of the user with a message of the new error occurrence when a new message becomes necessary apart from the content of the current message.

In the above statement, the control section is explained as a computer controlling function in which the function (according to the first embodiment) to halt the message for prompting the user to supply the consumables in accordance with the order defining information stored in the storing section and the function (according to the second embodiment) for displaying the additional message occurrence by posing the message currently on display when it becomes necessary to display a message different from the message currently on display are activated by using the CPU to execute the predetermined program stored preliminary in the ROM. However, the present invention shall not be limited to such exemplification. More specifically, the above described two functions or either one of them can be substituted with an electronic circuit to be used only for this purpose.

In the above statement, the explanation has been made referring to a case where the present invention is applied to the printer; however, the present invention should not be limited to this example. Namely, the present invention is applicable to a facsimile machine, a copying machine and the like.

As described above, it is obvious that this invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus using a plurality of different consumables for displaying a message for prompting a user to supply any one of the consumables when a remaining amount of the one consumable becomes less than a prescribed amount, the apparatus comprising:

a communication section for receiving order-defining information from an external device, the order-defining information stating that an order for the one consumable has already been completed;

a storing section for storing the received order-defining information;

a display section including a first indication region and a second indication region, the first and second indication regions being disposed adjacent to each other, wherein the first indication region displays consumable status information by identifying a consumable whose remaining amount is less than a prescribed amount, and the second indication region displays consumable order information by identifying a consumable an order for which has been already ordered; and a control section controlling the display section, the control section halting a message to prompt a user to supply the consumable that is in accordance with the received order-defining information stored in the storing section, wherein the control section, while halting the message to prompt, controls the display section to display the consumable order information indicating that the consumable in accordance with the received order-defining information has already been ordered, the consumable order information being displayed at least by identifying the consumable in accordance with the received order-defining information, and wherein the control section controls the display section to display a new error message where a new error occurs regardless of whether the order-defining information is already made or not.

2. The image forming apparatus according to claim 1, wherein the consumables include toner cartridges, and the toner cartridges can be ordered by said external device.

3. The image forming apparatus according to claim 1, wherein the storing section includes a nonvolatile memory.

4. An image forming apparatus using a plurality of different consumables for displaying a message for prompting a user to supply any one of the consumables when a remaining amount of the one consumable becomes less than a prescribed amount, the apparatus comprising:

a communication section for receiving order-defining information from an external device, the order-defining information stating that an order for the one consumable has already been completed;

a storing section for storing the received order-defining information;

a display section including a first indication region and a second indication region, the first and second indication regions being disposed adjacent to each other, wherein the first indication region displays consumable status information by identifying a consumable whose remaining amount is less than a prescribed amount, and the second indication region displays consumable order information by identifying a consumable an order for which has been already ordered, the second indication region including an order indication and a plurality of indications that are displayed side by side, each indication identifying a corresponding one of the consumables; and a control section controlling the display section, the control section halting a message to prompt a user to supply the consumable that is in accordance with the received order-defining information stored in the storing section, wherein the control section, while halting the message to prompt, controls the display section to display the consumable order information indicating that the consumable in accordance with the received order-defining information has already been ordered, the consumable order information being displayed by highlighting the order indication and the one of the indications that identifies the consumable in accordance with the received order-defining information, and wherein the control section controls the display section to display a new error message where a new error occurs regardless of whether the order-defining information is already made or not.

5. An image forming apparatus using a plurality of different consumables for displaying a message for prompting a user to supply any one of the consumables when a remaining amount of the one consumable becomes less than a prescribed amount, the apparatus comprising:

a communication section for receiving order-defining information from an external device, the order-defining information stating that an order for the one consumable has already been completed;

a storing section for storing the received order-defining information;

a display section including a first indication region and a second indication region, the first and second indication regions being disposed adjacent to each other, wherein the first indication region displays consumable status information by identifying a consumable whose remaining amount is less than a prescribed amount, and the second indication region displays consumable order information by identifying a consumable an order for which has been already ordered, the second indication region including a plurality of indications, each indication identifying a corresponding one of the plurality of consumables;

a control section controlling the display section, the control section halting a message to prompt the user to supply the consumable that is in accordance with the received order-defining information stored in the storing section, wherein the control section, while halting the message to prompt, controls the display section to display the consumable order information indicating that the consumable in accordance with the received order-defining information has already been ordered, the consumable order information being displayed at least by highlighting the one of the indications that identifies the consumable in accordance with the received order-defining information, and wherein the control section controls the display section to display a new error message where a new error occurs regardless of whether the order-defining information is already made or not; and a remaining amount detecting section for detecting a remaining amount of a respective one of the consumables and informing the remaining amount to the control section.

6. The image forming apparatus of claim 5, wherein:

the remaining amount detecting section detects the remaining amount, while the control section continues to display the order message for said one of the consumables; and when the remaining amount detecting section detects that the remaining amount of a different one of the consumables becomes less than the prescribed amount, the control section further displays a low amount message that said different one of the consumables becomes less than the prescribed amount, while continuing to display the order message for said one of the consumables.

7. The image forming apparatus of claim 6, wherein:

the display section further includes a low amount indication; and the control section highlights the low amount indication when the remaining amount detecting section detects that the remaining amount of said different one of the consumables becomes less than the prescribed amount.

8. An image forming apparatus using a plurality of different consumables for displaying a message for prompting a user to supply any one of the consumables when a remaining amount of the one consumable becomes less than a prescribed amount, the apparatus comprising:

a communication section for receiving order-defining information from an external device, the order-defining information stating that an order for the one consumable has already been completed;

a storing section for storing the received order-defining information;

a display section including a plurality of indications that are displayed side by side, each indication identifying a corresponding one of the consumables; and a control section controlling the display section, the control section halting a message to prompt a user to supply the consumable that is in accordance with the received order-defining information stored in the storing section, wherein the control section, while halting the message to prompt, displays an order message indicating that the consumable in accordance with the received order-defining information has already been ordered, the order message being displayed at least by highlighting the one of the indications that identifies the consumable in accordance with the received order-defining information, and wherein the control section controls the display section to display a new error message where a new error occurs regardless of whether the order-defining information is already made or not, and wherein:

said plurality of indications that are displayed side by side are first indications of the display section, and the display section further includes a second indication, the second indication displaying that a remaining amount of a respective one of the consumables becomes less than a prescribed amount, the second indication being displayed adjacent to the first indications;

the image forming apparatus further includes a remaining amount detecting section for detecting a remaining amount of the respective one of the consumables and informing the remaining amount to the control section, the remaining amount detecting section detecting the remaining amount, while the control section continues to display the order message for the consumable that is in accordance with the received order-defining information; and when the remaining amount detecting section detects that the remaining amount of a different one of the consumables becomes less than the prescribed amount, the control section further displays a low amount message that said different one of the consumables becomes less than the prescribed amount by highlighting the second indication, while continuing to display the order message for the consumable that is in accordance with the received order-defining information.

* * * * *